US007364482B1

(12) United States Patent
Wong et al.

(10) Patent No.: US 7,364,482 B1
(45) Date of Patent: Apr. 29, 2008

(54) POWER STEERING SYSTEMS FOR MULTIPLE STEERING ACTUATORS

(75) Inventors: Ray Tat-Lung Wong, Richmond (CA); Eric B. Fetchko, Burnaby (CA)

(73) Assignee: Teleflex Canada Inc., Richmond (CA)

( * ) Notice: Subject to any disclaimer, the term of this patent is extended or adjusted under 35 U.S.C. 154(b) by 0 days.

(21) Appl. No.: 11/703,106

(22) Filed: Feb. 7, 2007

(51) Int. Cl.
*B63H 21/22* (2006.01)

(52) U.S. Cl. ..... 440/1; 440/61 S

(58) Field of Classification Search ..... 440/1, 440/61 S

See application file for complete search history.

(56) References Cited

U.S. PATENT DOCUMENTS 5,427,045 A 6/1995 Fetchko
5,717,330 A 2/1998 Moreau et al.
5,717,339 A 2/1998 Murphy et al.
5,775,102 A 7/1998 Frye et al.
5,857,488 A 1/1999 Kobelt
6,500,037 B1 12/2002 Hedlund et al.
6,651,574 B1 11/2003 Ellens et al.
6,892,662 B2 * 5/2005 Watanabe et al. ..... 114/144 R
2006/0272881 A1 12/2006 Dudra et al.

* cited by examiner

*Primary Examiner*—Stephen Avila
(74) *Attorney, Agent, or Firm*—Cameron IP

(57) ABSTRACT

A hydraulic steering system comprises two hydraulic actuators, each having two actuator ports. There is a helm for steering the system in a first direction and a second direction. The helm is operatively connected to a helm pump. The helm is operatively connected to a first actuator port and a second actuator port. There is a power hydraulic steering pump hydraulically connected to a third of the actuator ports and a fourth of the actuator ports. There is a sensor capable of detecting steering of the system. The sensor is operatively connected with the power steering pump such that the power steering pump pumps hydraulic fluid towards the third of the actuator ports when the helm is steered in the first direction and pumps hydraulic fluid towards the fourth of the actuator ports when the helm is steered in the second direction.

28 Claims, 8 Drawing Sheets

POWER STEERING SYSTEMS FOR MULTIPLE STEERING ACTUATORS

BACKGROUND OF THE INVENTION

This invention relates to hydraulic steering systems and, in particular, to multiple cylinder hydraulic steering systems typically used in marine craft such as boats with double or triple outboard engines or twin rudder inboard engines.

In a typical multiple cylinder hydraulic steering system, a second cylinder is piped in parallel with a first cylinder thereby increasing the cylinder volume supplied by the helm pump. This requires the use a helm pump that discharges a higher volume of hydraulic fluid per revolution, as compared to a helm pump used in a single cylinder hydraulic system, to keep the lock to lock turns within desired limits and generally equivalent to the number in a single cylinder system. As a result, an original equipment manufacture such as boat builder has to stock two or more types of helm pumps to deal with single cylinder systems and multiple cylinder systems.

There is therefore a need for multiple cylinder hydraulic steering system that may use the helm pump of a single cylinder hydraulic steering system.

SUMMARY OF THE INVENTION

According to an aspect of the present invention there is provided a hydraulic steering system comprising a first hydraulic actuator and a second hydraulic actuator. Each of the hydraulic actuators has two actuator ports. One of the actuator ports of each hydraulic actuators receives hydraulic fluid to steer the system in a first direction and discharges hydraulic fluid when the system is steered in a second direction, which is opposite the first direction. Another of the actuator ports of each hydraulic actuator receives hydraulic fluid to steer the system in the second direction and discharges hydraulic fluid when the system is steered in the first direction.

There is a helm for steering the system in the first direction and the second direction. The helm has a helm pump operatively connected therewith. The helm pump has a first helm hydraulic port and a second helm hydraulic port. The first helm hydraulic port discharges hydraulic fluid when the helm is steered in the first direction and receives hydraulic fluid when the helm is steered in the second direction. The second helm hydraulic port discharges hydraulic fluid when the helm is steered in the second direction and receives hydraulic fluid when the helm is steered in the first direction. The helm pump is hydraulically connected with a first of the actuator ports and a second of the actuator ports. A power hydraulic steering pump hydraulically connects to a third of the actuator ports and a fourth of the actuator ports.

There is a sensor capable of detecting steering of the system. The sensor is operatively connected with the power steering pump such that the power steering pump pumps hydraulic fluid towards the third of the actuator ports when the helm is steered in the first direction and pumps hydraulic fluid towards the fourth of the actuator ports when the helm is steered in the second direction.

According to another aspect of the invention, there is provided a hydraulic steering apparatus comprising a helm having a helm pump operatively connected thereto. There is a first hydraulic actuator and a second hydraulic actuator. Each hydraulic actuator has two actuator ports for inputting and discharging hydraulic fluid when the hydraulic actuator is steered. One of the actuator ports of each hydraulic actuator receives hydraulic fluid and another of the actuator ports of each hydraulic actuator discharges hydraulic fluid when the apparatus is steered in a first direction. One of the actuator ports of each hydraulic actuator discharges hydraulic fluid and another of the actuator ports of each hydraulic actuator receives hydraulic fluid when the apparatus is steered in a second direction, opposite the first direction. The helm pump has helm ports hydraulically connected to a first of the actuator ports and a second of the actuator ports. A third of the actuator ports and a fourth of the actuator ports are hydraulically independent of the helm hydraulic ports during a normal steering mode of the apparatus.

There is a sensor for sensing steering by the helm. A powered hydraulic pump is hydraulically connected to the third of the actuator ports and the fourth of the actuator ports and operatively connected to the sensor. The powered hydraulic pump pumps hydraulic fluid to the third of the actuator ports when the apparatus is steered by the helm in the first direction and pumps hydraulic fluid to the fourth of the actuator ports when the apparatus is steered by the helm in the second direction.

According to yet another aspect of the present invention there is provided a hydraulic steering system including a steering wheel, a first hydraulic steering apparatus, a second hydraulic steering apparatus and two hydraulic actuators. Each of the hydraulic actuators has two actuator ports for receiving or discharging hydraulic fluid. The steering wheel and the first hydraulic steering apparatus are hydraulically connected to a first two of the actuator ports. The second hydraulic steering apparatus includes a powered hydraulic pump. The powered hydraulic pump is hydraulically connected to a second two of the actuator ports. A sensor is operatively associated with the first hydraulic steering apparatus for sensing movement of at least one of the hydraulic actuators when the steering wheel is steered. A controller is operatively connected to the powered hydraulic pump and to the sensor. The controller operates the powered hydraulic pump to pump hydraulic fluid to the second two of the actuator ports so that the two hydraulic actuators move in conjunction with each other.

The present invention offers an advantage over earlier multiple hydraulic power assist steering systems by not requiring a helm pump that discharges a higher volume of hydraulic fluid per revolution, as compared to a helm pump used in a single cylinder hydraulic steering system, thereby eliminating the need for original equipment manufacturers to stock two or more types of helm pumps to deal with single cylinder systems and multiple cylinder systems. Similarly, another advantage of the present invention is that it reduces the steering effort required by the helmsman.

DETAILED DESCRIPTION OF THE PREFERRED EMBODIMENTS

Figure 1:
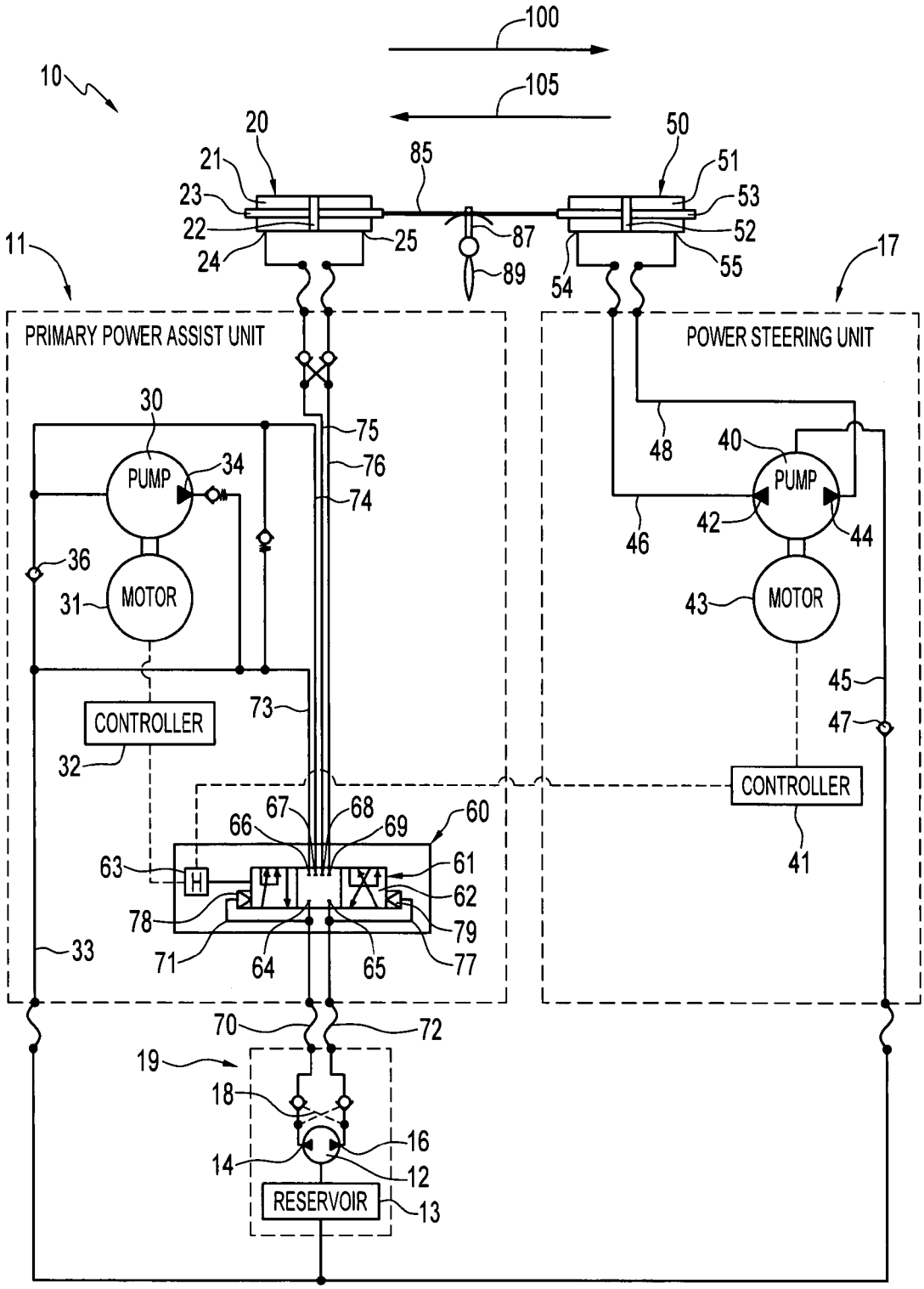
FIG. 1 is a schematic diagram of a multiple cylinder power hydraulic steering system according to an embodiment of the invention.

Referring to the drawings and first to FIG. 1, there is shown a hydraulic steering system 10 according to a first embodiment of the invention. The hydraulic steering system 10 includes a manually operable hydraulic pump or helm pump 12 that forms part of a helm generally indicated by reference numeral 19. The helm 19 has a steering wheel (not shown) operatively connected to the helm pump 12. The helm pump, 12 is hydraulically connected to a first hydraulic actuator 20. A power assist hydraulic pump 30 is connected hydraulically in series between the helm pump 12 and the first hydraulic actuator 20. A sensing mechanism 60 is connected hydraulically in series between the helm pump 12 and the power assist pump 30. The power assist pump 30 and the sensing mechanism 60 form part of a primary power assist unit indicated generally by reference numeral 11. In the embodiment of FIG. 1, the sensing mechanism 60 is comprised of a control valve 61 having a valve member 62 reciprocatingly received therein, and a position sensor 63. The position sensor 63 senses the displacement of the valve member 62 within the control valve 61. However, it will be understood by a person skilled in the art that in alternate embodiments of the invention the sensing mechanism may be a volume flow sensor that senses a volume of fluid discharged by the helm pump 12.

A powered hydraulic pump 40 is hydraulically connected to a second hydraulic actuator 50. The powered hydraulic pump 40 forms part of a power steering unit indicated generally by reference numeral 17. The hydraulic actuators 20 and 50 are in the form of steering actuators provided with cylinders 21 and 51, pistons 22 and 52, and piston rods 23 and 53 respectively. In this example, the hydraulic actuators 20 and 50 are connected by an elongated member in the form of a tie-bar 85. The tie-bar 85 is connected to a tiller 87 which in turn is connected to a rudder 89 which steers a marine craft (not shown). The tiller 87 is hard coupled.

The helm pump 12 is connected to a reservoir 13 and has a first helm hydraulic port 14 and a second helm hydraulic port 16. Fluid is discharged by the first helm hydraulic port 14 and fluid is received by the second helm hydraulic port 16 when the helm pump 12 is operated to move the first hydraulic actuator 20 in a first direction indicated generally by arrow 100. Fluid is discharged by the second helm hydraulic port 16 and fluid is received by the first helm hydraulic port 14 when the helm pump 12 is operated to move the first hydraulic actuator 20 in a second direction indicated generally by arrow 105. The second direction 105 is opposite to the first direction 100. The helm 19 is further equipped with a conventional lock valve 18 that prevents a back flow of fluid to the helm pump 12. A pair of hydraulic conduits 70 and 72 hydraulically connect the first and second helm hydraulic ports 14 and 16 to the control valve 61.

In the embodiment of the invention illustrated in FIG. 1, the control valve 61 is a 3-position, 6-way directional spool valve and the valve member 62 is the spool thereof. The control valve 61 may be similar to the spool valve disclosed in U.S. patent application Ser. No. 10/507,833 to Dudra et al., which is incorporated herein by reference. The control valve 61 has a series of valve ports 64, 65, 66, 67, 68 and 69. Hydraulic conduit 70 is received at valve port 64 and hydraulic conduit 72 is received at valve port 65. The control valve 61 is hydraulically connected to the power assist pump 30 by hydraulic conduit 73 received at valve port 66 and by hydraulic conduit 74 received at valve port 67. The control valve 61 is hydraulically connected to the first hydraulic actuator 20 by hydraulic conduit 75 received at valve port 68 and by hydraulic conduit 76 received at valve port 69.

When the helm pump 12 is operated to move the first hydraulic actuator 20 in the first direction indicated by arrow 100, fluid discharged by the first helm hydraulic port 14 flows through conduit 70 and into the control valve 61 at valve port 64. Simultaneously, fluid is provided to an actuator 78 on the control valve 61 via hydraulic conduit 71. The actuator 78 causes the valve member 62 to move in a manner that allows the power assist pump 30 to assist the flow of fluid through the control valve 61, and to the first hydraulic actuator 20 where it is received at a first actuator port 24. It will be understood that as the first hydraulic actuator 20 moves in the first direction that fluid is discharged by the first hydraulic actuator 20 at a second actuator port 25. The fluid discharged by the first hydraulic actuator 20 at the second actuator port 25 flows through conduit 76, through the control valve 61 and into the second helm hydraulic port 16 of the helm pump 12.

When the helm pump 12 is operated to move the first hydraulic actuator 20 in the second direction indicated by arrow 105, fluid discharged by the second helm hydraulic port 16 flows through conduit 72 and into the control valve 61 at valve port 65. Simultaneously fluid is provided to an actuator 79 on the control valve 61 via hydraulic conduit 77. The actuator 79 causes the member 62 to move in a manner which allows the power assist pump 30 to assist the flow of fluid through the control valve 61, through conduit 76, to the first hydraulic actuator 20 where it is received at the second actuator port 25. It will be understood that as the first hydraulic actuator 20 moves in the second direction 105 that fluid is discharged by the first hydraulic actuator 20 at the first actuator port 24. The fluid discharged by the first hydraulic actuator 20 at the first actuator port 24 flows through conduit 75, through the control valve 61 and into the first helm hydraulic port 14 of the helm pump 12.

An operating mechanism for operating the power assist pump actuates the power assist pump 30 to assist the flow of fluid from the helm pump 12 to the first hydraulic actuator 20. The operating mechanism for operating the power assist pump includes a controller 32 and a variable speed motor 31, which operate in conjunction with the sensing mechanism 60. The sensing mechanism 60 also forms part of the primary power assist unit 11 in the embodiment of FIG. 1. The controller 32 is a proportional controller. The variable speed motor 31 is operatively connected to the power assist pump 30. When fluid is discharged by the helm pump 12, the valve member 62 is displaced within the control valve 61. The displacement of the valve member 62 is proportional to the volume of fluid discharged from the helm pump 12. The position sensor 63, a linear variable differential transformer in the embodiment of FIG. 1, senses the displacement of the valve member 62 and signals the controller 32. The controller 32, is operatively connected to the variable speed motor 31 and, in turn, signals the variable speed motor 31 to actuate the power assist pump 30. The operating speed of the variable speed motor 31 is proportional to the relative displacement of the valve member 62 within the control valve 61. The operation of the power assist pump 30 is therefore dependent on the volume of fluid discharged by the helm pump 12.

The power assist pump 30 is hydraulically connected to the reservoir 13 by hydraulic conduit 33. A conventional check valve 36 prevents a back flow of fluid from the power assist pump 30 to the reservoir 13. The power assist pump 30 has a pump port 34. When the helm pump 12 is operated to move the first hydraulic actuator 20 in the first direction indicated by arrow 100, the power assist pump 30 assists the flow of fluid by drawing fluid through conduits 33 and 74, then pumping the fluid through conduits 73 and 75 to the first hydraulic actuator 20. When the helm pump 12 is operated to move the first hydraulic actuator 20 in the second direction indicated by arrow 105, the power assist hydraulic pump 30 assists the flow of fluid by drawing fluid through conduits 33 and 74 then pumping the fluid through conduits 73 and 76 to the first hydraulic actuator.

In the power steering unit 17, the powered hydraulic pump 40 is hydraulically connected to the reservoir 13 by a hydraulic conduit 45. A conventional check valve 47 prevents a back flow of fluid from the powered hydraulic pump 40 to the reservoir 13. The power steering unit 17 is hydraulically independent of the primary power assist unit 11 apart from the reservoir 13, during a normal steering mode of operation. In an alternative embodiment, the power steering unit 17 may be completely hydraulically independent of the primary power assist unit 11 through the use of separate reservoirs for each unit 11 and 17, respectively.

The powered hydraulic pump 40 has a first powered hydraulic port 42 and a second powered hydraulic port 44. Fluid is discharged by the first powered hydraulic port 42 and fluid is received by the second powered hydraulic port 44 when the powered hydraulic pump 40 operates to move the second hydraulic actuator 50 in the first direction indicated by arrow 100. Fluid is discharged by the second powered hydraulic port 44 and fluid is received by the first powered hydraulic port 42 when the powered hydraulic assist pump 40 operates to move the second hydraulic actuator 50 in the second direction indicated by arrow 105. Hydraulic conduits 46 and 48 hydraulically connect the powered hydraulic pump 40 to the second hydraulic actuator 50. Hydraulic conduit 46 is connected to first powered hydraulic port 42 and received by the second hydraulic actuator 50 at a third actuator port 54. Hydraulic conduit 48 is connected to the second powered hydraulic port 44 and received by the second hydraulic actuator 50 at a fourth actuator port 55.

An operating mechanism for operating the powered hydraulic pump 40 actuates the powered hydraulic pump 40 to move the second hydraulic actuator 50 when the helm pump 12 is operated. The operating mechanism for operating the powered hydraulic pump 40 includes a controller 41 and a variable speed motor 43 which operate in conjunction with the sensing mechanism 60 of the primary power assist unit 11. The controller 41 is a proportional controller and the variable speed motor 43 is operatively connected to the powered hydraulic pump 40. When fluid is discharged by the helm pump 12 the valve member 62 is displaced within the control valve 61. The displacement of the valve member 62 is proportional to the volume of fluid discharged from the helm pump 12. The position sensor 63, a linear variable differential transformer in the embodiment of FIG. 1, senses the displacement of the member 62 and signals the controller 41. The controller 41 is operatively connected to the variable speed motor 43 and, in turn, signals the variable speed motor to actuate the reversing assist pump 40. The speed of the variable speed motor 43 is proportional to the relative displacement of the member 62 within the control valve 61. Operation of the powered hydraulic pump 40 is therefore dependent to the volume of fluid discharged by the manual pump 12. It will be understood by a person skilled in the art that a reasonable variation can be found by connecting controller 32 to controller 41, or using the same controller to control the motor 43.

As can be seen from FIG. 1, the first hydraulic actuator 20 and the second hydraulic actuator 50 are not piped in parallel. The helm pump 12 and power assist pump 30 are responsible for fluid flow to the first hydraulic actuator 20. The powered hydraulic pump 40 is responsible for fluid flow to the second hydraulic actuator 50. Since the helm pump 12 is only responsible for fluid flow to the first hydraulic actuator 20, a helm pump that discharges a higher volume of fluid per revolution, as compared to a helm pump used in a single cylinder hydraulic steering system, is not required to keep the lock to lock turns in multiple cylinder hydraulic steering system 10 within desirable limits and generally equivalent to the number of turns found in a single cylinder hydraulic steering system. Simply put, the present invention allows for a helm pump that is designed for a single cylinder hydraulic steering system to be used in multiple cylinder hydraulic steering system.

Since the operation of the power steering unit 17 is dependent on the sensing mechanism 60 in the primary power assist unit 11, if the primary power assist unit 11 were to fail, the power steering unit 17 would also fail. However, because the powered hydraulic pump 40 does not have a lock valve, fluid would still be able to travel from one side of the second hydraulic actuator 50 to the other side of second hydraulic actuator with the only added resistance being the fluid motoring of the powered hydraulic pump 40, thereby still allowing the marine craft to be manually steered.

Figure 2:
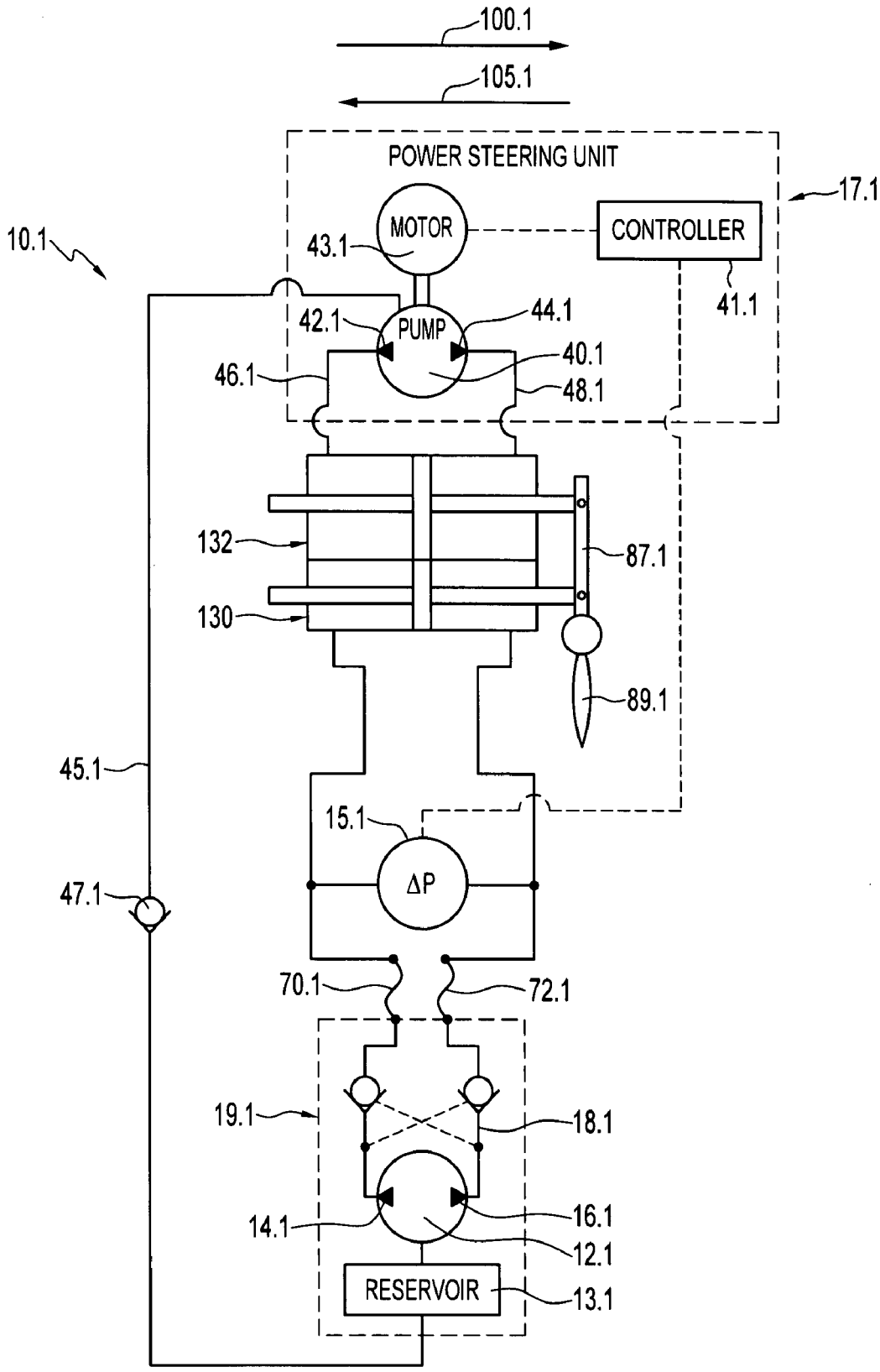
FIG. 2 is a schematic diagram of a multiple cylinder power hydraulic steering system according to a second embodiment of the invention wherein a first hydraulic actuator is a pilot actuator and a second hydraulic actuator is a power actuator.

Referring now to FIG. 2, a multiple cylinder hydraulic steering system 10.1 is shown according to a second embodiment of the invention wherein like parts have like reference numerals as in FIG. 1 with the additional designation "0.1" and wherein there is a differential pressure sensor 15.1 (also labelled ΔP). The differential pressure sensor 15.1 senses the difference in pressure between the fluid passing through hydraulic conduits 70.1 and 72.1. The controller 41.1 sends a pulse width modulation ("PWM")

signal that is associated with the sign and magnitude of the differential pressure at the differential pressure sensor 15.1. An example of one algorithm for the controller 41.1 is as follows. When the differential pressure at the pressure sensor 15.1 is within +/−20 psi, zero percent PWM will be applied to the motor 43.1. When the differential pressure is between 20 to 300 psi (or −20 to −300 psi), a look-up table of pressure-to-PWM is applied to the motor. This look up table is similar in shape to a convex precise linear function with two linear segments. Beyond a differential pressure of +/−300 psi, 100% PWM will be applied to the motor 43.1.

Otherwise, the embodiment of FIG. 2 is similar to the embodiment of FIG. 1 with the further exception that in the embodiment of FIG. 2 a first hydraulic actuator 130 is a pilot actuator and a second hydraulic actuator 132 is a power actuator. In order to enable the second hydraulic actuator 132 to help move the first hydraulic actuator 130, a flexible conduit 70.1 is provided. The flexible conduit 70.1 can expand and thereby act to reduce and absorb system lag time differences.

Figure 3:
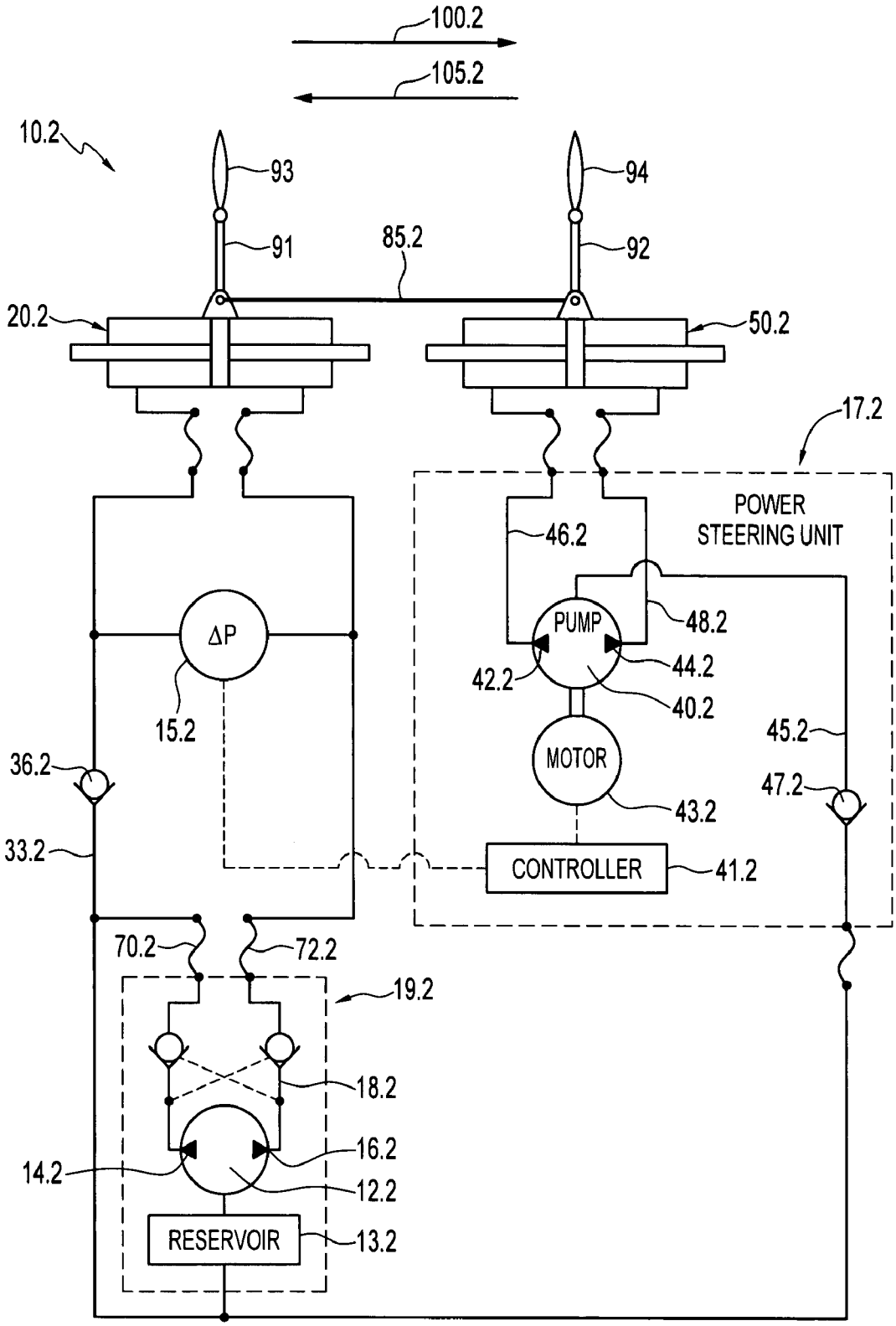
FIG. 3 is a schematic diagram of a multiple cylinder power hydraulic steering system according to a third embodiment of the invention.

Referring now to FIG. 3, a multiple cylinder hydraulic steering system is shown according to a third embodiment of the invention wherein like parts have like reference numerals as in FIG. 1 with the additional designation "0.2". The embodiment of FIG. 3 is similar to the embodiment of FIG. 1 with an exception being that it employs the differential pressure sensor 15.2. Also, the cylinders of the hydraulic actuators 20.2 and 50.2 are connected to the tillers 91 and 92. The tillers 91 and 92 move as the cylinders of the hydraulic actuators 20.2 and 50.2 move. The first and second hydraulic actuators 20.2 and 50.2 are independently connected to tillers 91 and 92 respectively. The rudders 93 and 94 are connected to the tillers 91 and 92, respectively.

Figure 4:
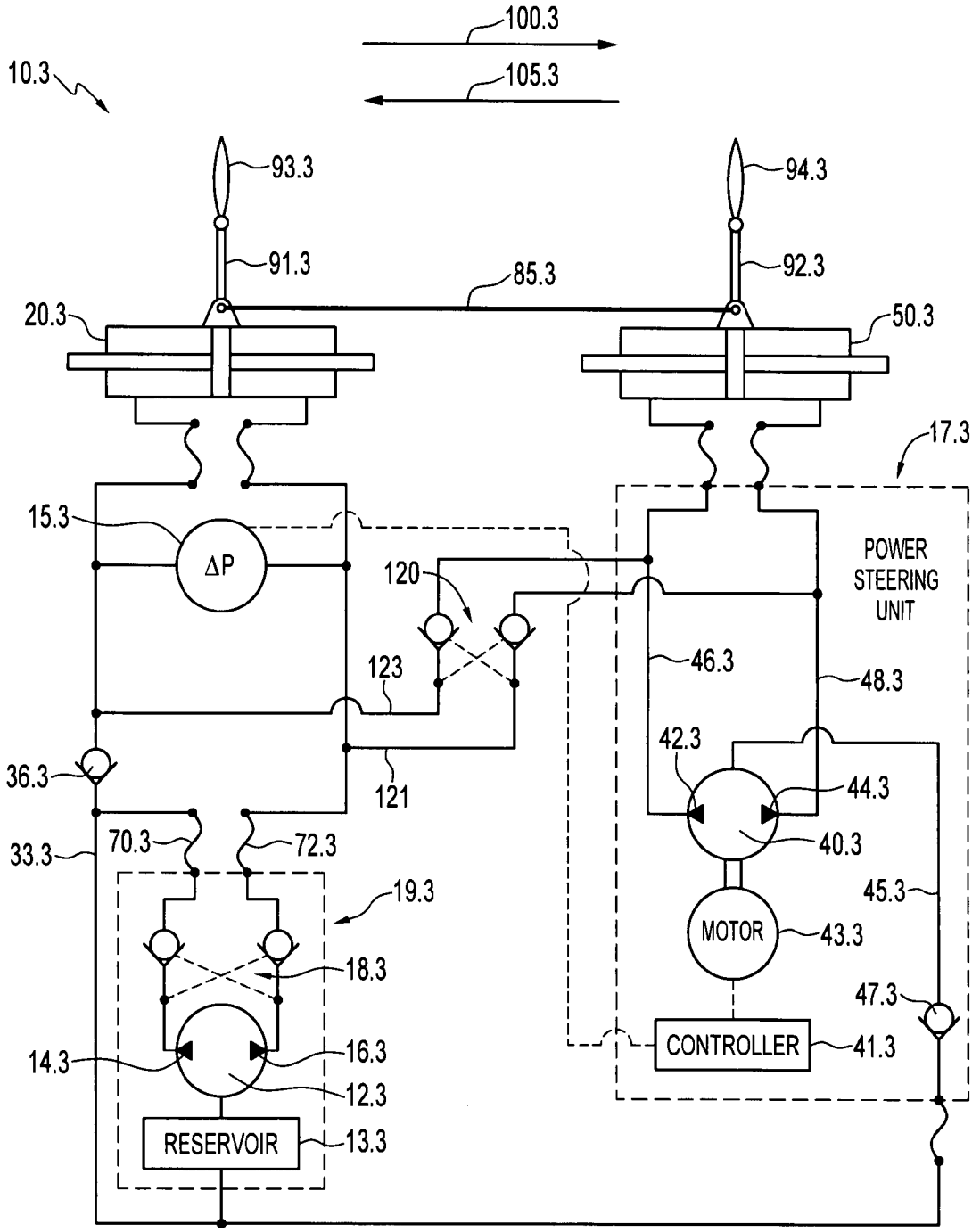
FIG. 4 is a schematic diagram of a multiple cylinder power hydraulic steering system according to a fourth embodiment of the invention wherein the first hydraulic actuator and the second hydraulic actuator are piped in parallel.

Referring now to FIG. 4, a multiple cylinder hydraulic steering system 10.3 is shown according to a fourth embodiment of the invention wherein like parts have been given like reference numerals as in FIGS. 1 and 3 with the additional designation "0.3". The embodiment of FIG. 4 is generally equivalent to the embodiment of FIG. 3 with an additional failsafe feature. In the embodiment of FIG. 4, the first hydraulic actuator 20.3 and second hydraulic actuator 50.3 are piped in parallel through the use of hydraulic conduits 121 and 123. Hydraulic conduits 121 and 123 are equipped with a lock valve 120. The lock valve 120 is set to be closed, preventing the flow of fluid from the helm pump 12.3 to the second hydraulic actuator 50.3, when the differential pressure sensor 15.3 is operational and there is a normal steering effort and a normal fluid pressure of, for example, 50 psi. However, if the differential pressure sensor 15.3 fails, an increased steering effort will be required resulting in an increased fluid pressure. An increased fluid pressure of, for example, 150 psi will cause the lock valve 120 to open and allow the flow of fluid from the helm pump 12.3 to flow to the second hydraulic actuator 50.3.

In the embodiment of FIG. 4, piping the first hydraulic actuator 20.3 and second hydraulic actuator 50.3 in parallel as described above prevents the flow of fluid from the helm pump 12.3 to the second hydraulic actuator 50.3 when the differential pressure sensor 15.3 is operational and there is a normal steering effort, but allows the flow of fluid from the helm pump 12.3 to the second hydraulic actuator 50.3 when the power steering unit 17.3 fails and there is an increased steering effort. This setup allows for the use of a helm pump that is designed for a single cylinder hydraulic steering system to be used in a multiple cylinder hydraulic steering systems because there is no fluid flow to the second hydraulic actuator 50.3 when the differential pressure sensor 15.3 is operational. However, there is the additional failsafe feature that if the power steering unit 17.3 fails, fluid is allowed to flow from the helm pump 12.3 to the second hydraulic actuator 50.3, thereby allowing the marine craft to be steered manually, albeit with increased lock to lock turns.

It will be understood by a person skilled in the art that, although in the embodiment of FIG. 4 a tie-bar 85.3 connects the first hydraulic actuator 20.3 to the second hydraulic actuator 50.3, the failsafe feature described herein will be especially useful when there is no mechanical connection between the first hydraulic actuator 20.3 and the second hydraulic actuator 50.3 as found, for example, in a catamaran. It will be further understood by a person skilled in the art that a typical fluid pressure of 50 psi and an increased fluid pressure of 150 psi are provided herein by way of example only and that alternate measures of normal fluid pressure and increased fluid pressure may used as appropriate.

Figure 5:
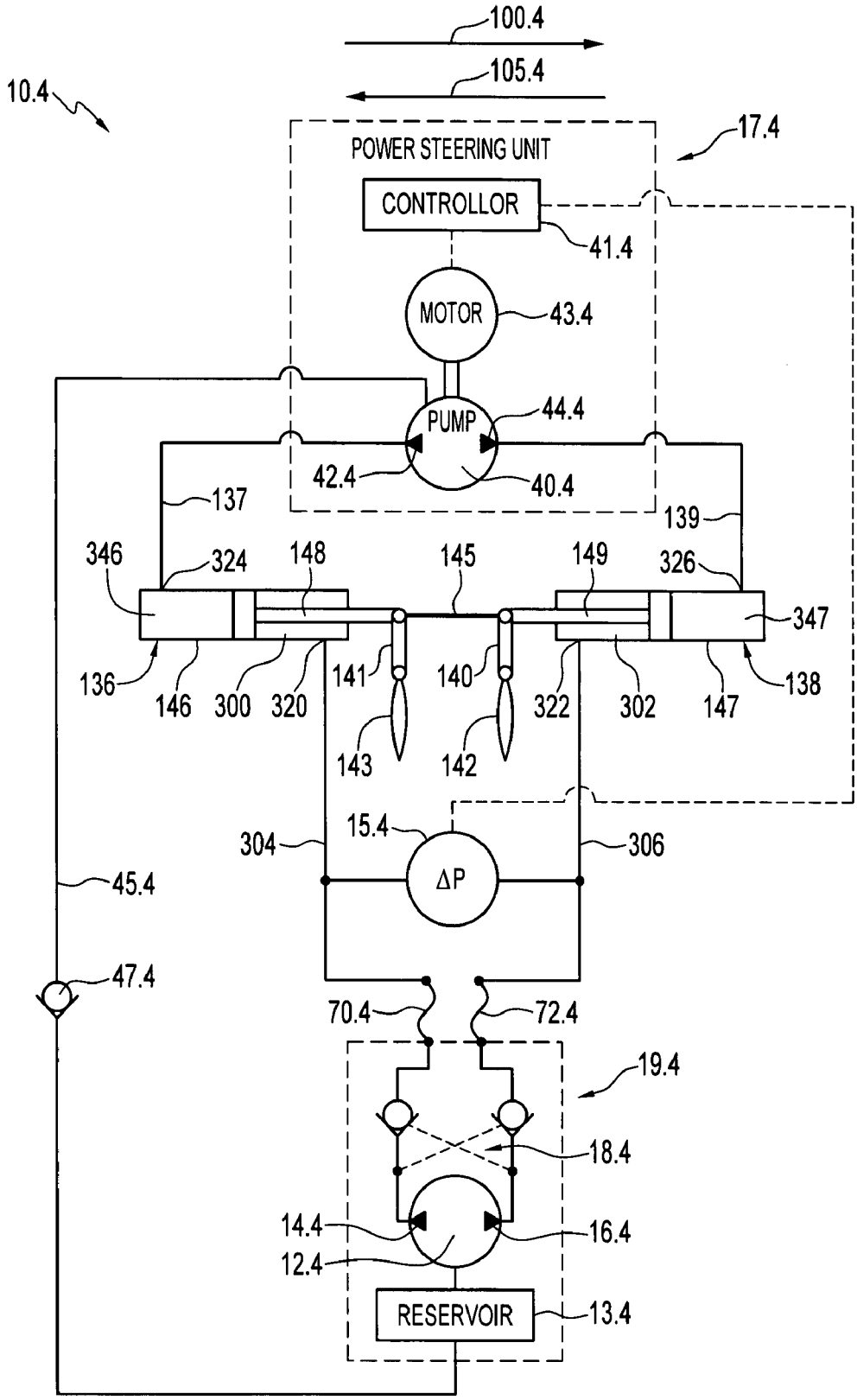
FIG. 5 is a schematic diagram of a multiple cylinder power hydraulic steering system according to a fifth embodiment of the invention wherein the first hydraulic actuator and the second hydraulic actuator are in the form of unbalanced cylinders.

Referring now to FIG. 5 a multiple cylinder hydraulic steering system 10.4 is shown according to a fifth embodiment of the invention wherein like parts have been given like reference numerals as in FIGS. 3 and 4, with the additional designation "0.4". In the embodiment of FIG. 5, a first hydraulic actuator 136 and a second hydraulic actuator 138 are in the form of cylinders 146 and 147, each having a single piston rod 148 or 149 respectively. The helm pump 12.4 and differential pressure sensor 15.4 are hydraulically connected in series to the rod side or helm side 300 and 302 of each said hydraulic actuator 136 and 138 at a first actuator port 320 and a second actuator port 322 by hydraulic conduits 304 and 306 respectively. The powered hydraulic pump 40.4 of the power steering unit is hydraulically connected to the power side 346 and 347 of each said hydraulic actuator 136 and 138 at a third actuator port 324 and a fourth actuator port 326 by hydraulic conduits 137 and 139 respectively. The power side 346 and 347 of each said hydraulic actuator 136 and 138 has a greater volume than its corresponding helm side 300 and 302, since there is no piston rod on the powered sides An elongate member in the form of a tie bar 145 connects the piston rod 148 of the first hydraulic actuator 136 to the piston rod 149 of the second hydraulic actuator 138. The tie-bar 145 is further connected to a tillers 140 and 141 which in turn are connected to rudders 142 and 143 respectively which steer the marine craft (not shown).

When the helm pump 12.4 is operated to move the first hydraulic actuator in the first direction indicated by arrow 100.4, fluid is discharged by the second helm hydraulic port 16.4 of the helm 12.4. The fluid flows through conduit 72.4 through conduit 306 to the rod side 302 of the second hydraulic actuator 138 at the second actuator port 322, causing the second hydraulic actuator 138 to move in the first direction. During this time, the differential pressure sensor 15.4 signals to the power steering unit 17.4, in a manner as described above for the embodiment of FIG. 2, to pump fluid from the powered hydraulic pump 40.4. Fluid is pumped from the first powered hydraulic port 42.4 of the powered hydraulic pump 40.4 through conduit 137 to the power side 146 of the first hydraulic actuator 136 at the third actuator port 324, causing the first hydraulic actuator 136 to move in the first direction.

It will be understood by a person skilled in the art that as the first hydraulic actuator 136 moves in the direction indicated by arrow 100.4, fluid is discharged by the first hydraulic actuator 136 at the first actuator port 320. The fluid discharged by the first hydraulic actuator 136 at the first actuator port 320 flows through conduit 304, and into the helm pump 12.4 at the first helm hydraulic port 14.4. It will further be understood that as second hydraulic actuator 138 moves in the first direction indicated by arrow 100.4, that fluid is discharged by the second hydraulic actuator at a fourth actuator port 326. The fluid discharged by the second hydraulic actuator 138 flows through conduit 139 and into the powered hydraulic pump 40.4 at the second powered hydraulic port 44.4.

When the manual pump 12.4 is operated to move the first hydraulic actuator in the second direction indicated by arrow 105.4, fluid is discharged by the first helm hydraulic port 14.4 of the helm pump. The fluid flows through conduit 70.4 through conduit 304 to the rod side 300 of the first hydraulic actuator 136 at the first actuator port 320, causing the first hydraulic actuator 20.4 to move in the first direction. During this time, the differential pressure sensor 15.4 signals to the power steering unit 17.4, in a manner as described above for the embodiment of FIG. 2, to pump fluid from the powered hydraulic pump 40.4. Fluid is pumped from the second powered hydraulic port 44.4 of the powered hydraulic pump 40.4 through conduit 139 to the power side 147 of the second hydraulic actuator 138 at the fourth actuator port 326, causing the second hydraulic actuator 138 to move in the second direction.

It will be understood by a person skilled in the art that as the first hydraulic actuator 136 moves in the second direction indicated by arrow 105.4 that fluid is discharged by the first hydraulic actuator 136 at the third actuator port 324. The fluid discharged by the first hydraulic actuator 136 at the third actuator port 324 flows through conduit 137 into the powered hydraulic pump 40.4 at the first powered hydraulic port 42.4. It will further be understood that as the second hydraulic actuator 138 moves in the second direction indicated by arrow 105.4 that fluid is discharged by the second hydraulic actuator at port 322. The fluid discharged by the second hydraulic actuator 138 flows into the helm pump 12.4 at the second helm hydraulic port 16.4.

By using cylinders where the manual sides have a lesser volume than the power sides, the embodiment of FIG. 5 offers the advantage of requiring lower lock to lock turns to steer the marine craft, since the volume displaced by the helm pump 12.4 is reduced for a given degree of turn.

Figure 6:
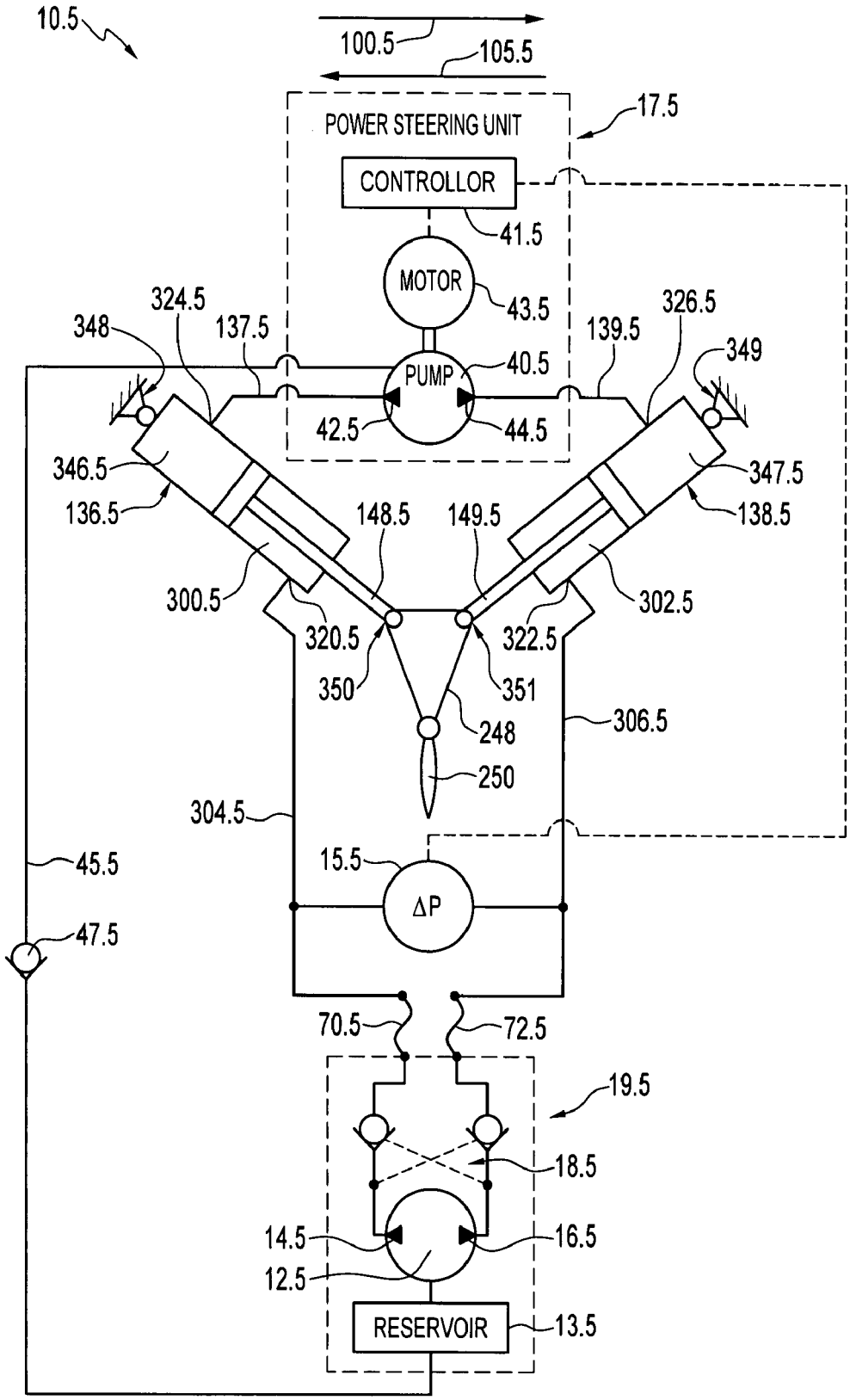
FIG. 6 is a schematic diagram of a multiple cylinder power hydraulic steering system according to a sixth embodiment of the invention wherein the first hydraulic actuator and the second hydraulic actuator are in the form of unbalanced cylinders.

Referring now to FIG. 6, a power hydraulic steering system 10.5 is shown according to a fifth embodiment of the invention wherein like parts have been given like reference numerals as in FIGS. 1 and 5 with the additional designation "0.5". The embodiment of FIG. 6 is similar to the embodiment of FIG. 5 with the exception that cylinder rods 148.5 and 149.5 of the first and second hydraulic actuators 136.5 and 138.5 are connected to a single tiller 248 and rudder 250 which steer a marine craft (not shown). The rods 148.5 and 149.5 are pivotally connected to the single tiller 248 by pivots 350 and 351. The first and second hydraulic actuators 136.5 and 138.5 are also pivotally mounted on their power sides 346.5 and 347.5. by pivots 348 and 349. The first and second hydraulic actuators 136.5 and 138.5 are angularly spaced respective to each other. This offers the additional advantage of an increased displacement of the tiller 248 and the rudder 250 relative to the displacement of the first and second hydraulic actuators 136.5 and 138.5 as compared to the embodiment of FIG. 5.

Figure 7:
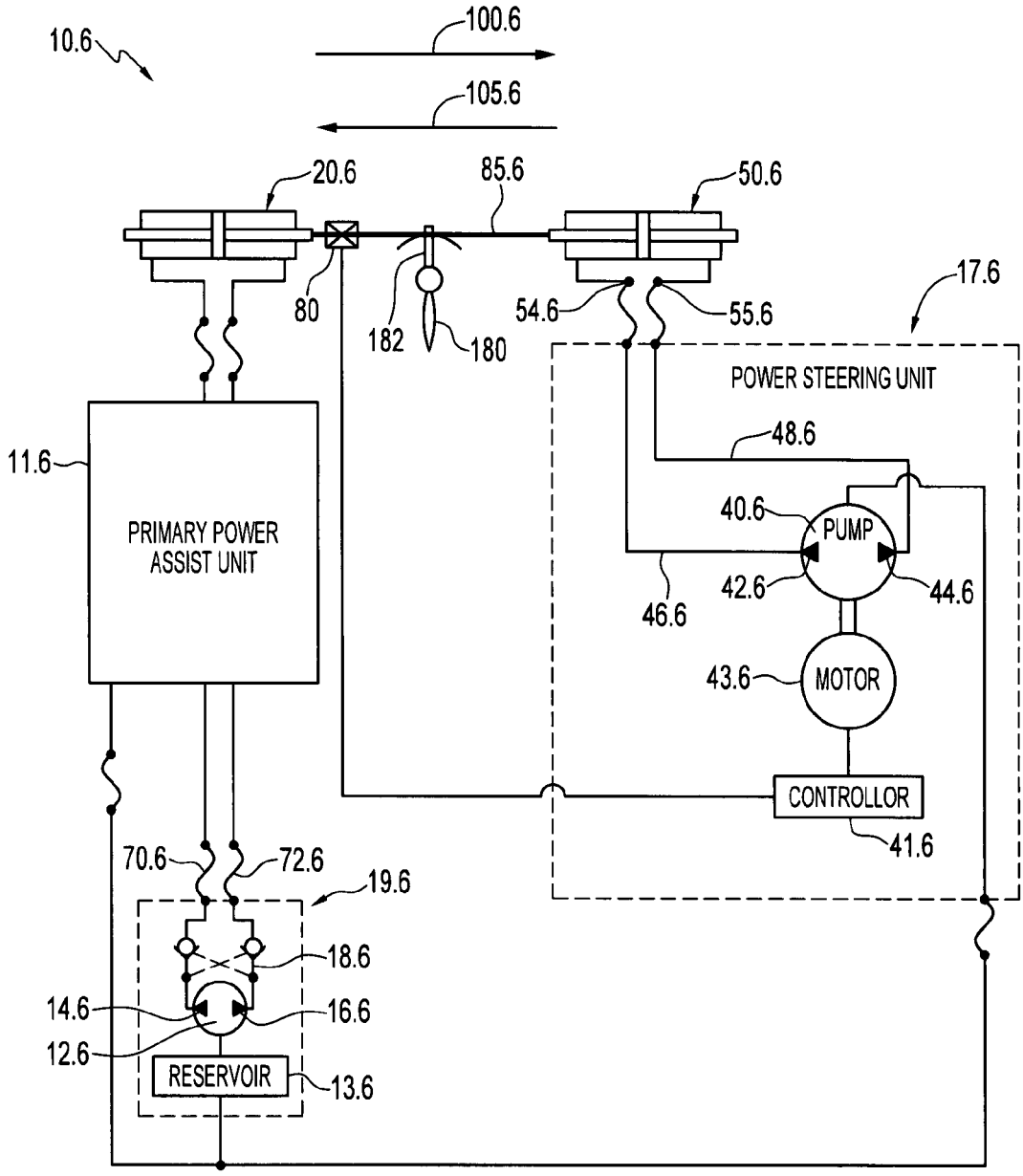
FIG. 7 is a schematic diagram of a multiple cylinder power hydraulic steering system according to a seventh embodiment of the invention wherein the operating mechanism for operating a power steering unit comprises a controller operatively connected to a load sensor mounted on a tie bar.

Referring now to FIG. 7, a power hydraulic steering system 10.6 is shown according to a seventh embodiment of the invention wherein like parts have like reference numerals as in FIG. 1 with the additional designation "0.6", and wherein there is a primary power assist unit 11.6. The embodiment of FIG. 7 is generally equivalent to the embodiment of FIG. 1 with the exception that in the embodiment of FIG. 7 the operating mechanism for operating the power steering unit 17.6 is operatively connected to a load sensor 80 mounted on the tie bar 85.6. The load sensor 80 senses load forces applied to the first hydraulic actuator 20.6 by the helm pump and the primary power assist unit 11.6, and signals the controller 41.6 of the operating mechanism for operating the power steering unit to operate the powered hydraulic pump 40.6 based on the load forces. This differs from the embodiment of FIG. 1 wherein the position sensor 63 of the sensing mechanism in the primary power assist unit 11 signals the power steering unit 17.

In the embodiment of the invention illustrated in FIG. 7, the load sensor 80 includes a pair of axial gauges and a pair of Poisson gauges and is mounted on the tie-bar 85.6 which connects first and second hydraulic actuators 20.6 and 50.6. However, other custom load cells or a commercially available load cell such as a Futek Model L2700 load cell may be used. Alternatively, other methods of sensing load forces may be used such as a spring connecting a first portion of the tie-bar to a second portion of the tie-bar. As load forces act on the first actuator, the spring will compress or extend in response to the load. The displacement of the spring can be measured and a signal can be sent to the controller to operate the pump in response to the magnitude and direction of the load force.

The embodiment of FIG. 7 offers the advantage that operation of the power steering unit 17.6 is based on the load forces applied to the first hydraulic actuator 20.6 rather than the volume of fluid discharged by the manual pump 12.6. This provides greater steering control.

Figure 8:
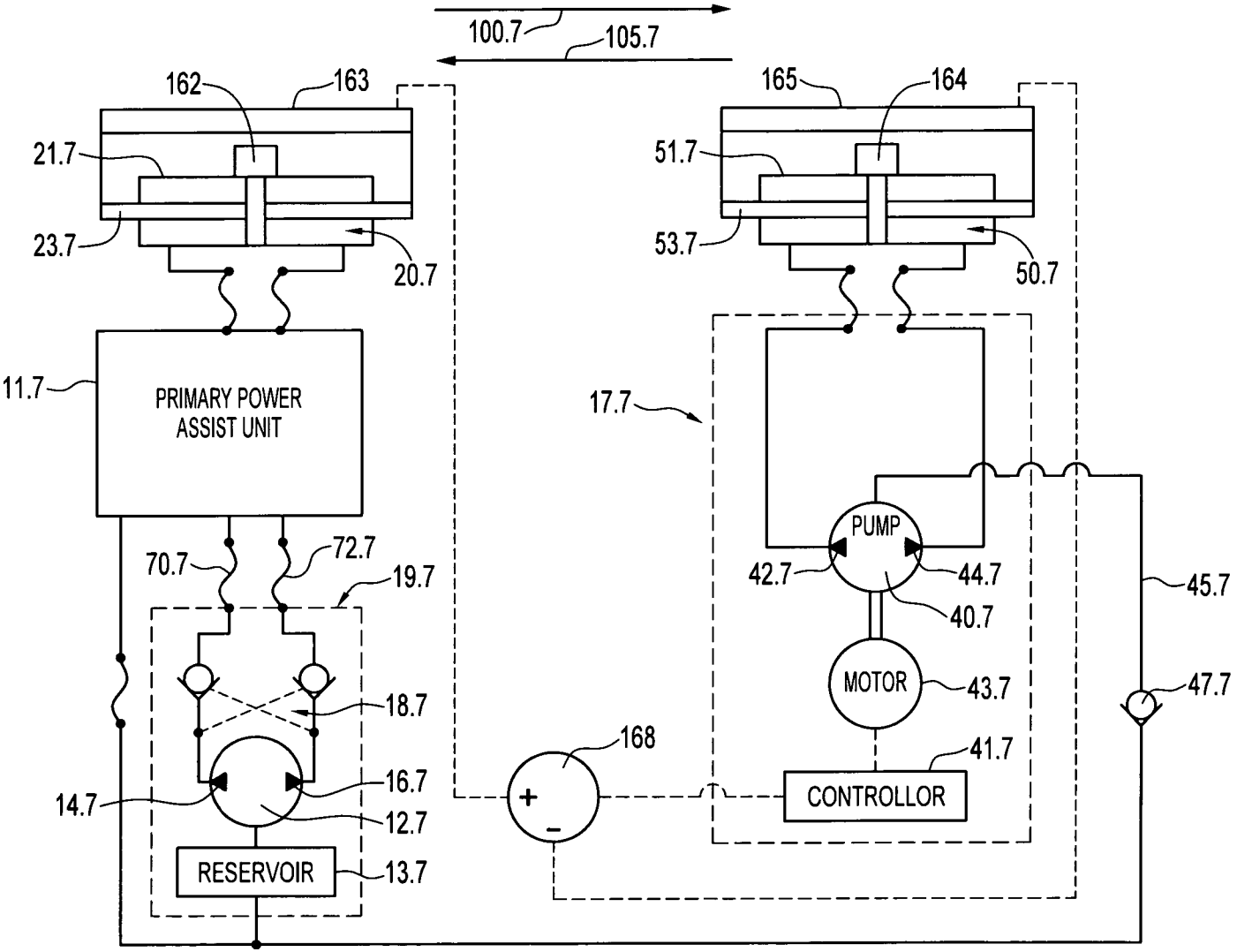
FIG. 8 is a schematic diagram of a multiple cylinder power hydraulic steering system according to an eighth embodiment of the invention wherein there is no mechanical connection between a first hydraulic actuator and a second hydraulic actuator, and the operating mechanism for operating a secondary power assist unit comprises a controller operatively connected to a potentiometer.

Referring now to FIG. 8, a multiple cylinder hydraulic steering system 10.7 is shown according to a eighth embodiment of the invention wherein like parts have been given like numerals as in FIG. 1 with the additional designation "0.7", and wherein there is a primary power assist unit 11.7. In the embodiment of FIG. 8 there is no mechanical connection between the first hydraulic actuator 20.7 and second hydraulic actuator 50.7. The operating mechanism for operating the power steering unit is operatively connected to a potentiometer 168. The positions of the first and second hydraulic actuators 20.7 and 50.7 are tracked by magnetostrictive sensors 163 and 165 which monitor the movement of magnets 162 and 164 which are mounted on the first and second hydraulic actuators 20.7 and 50.7 respectively. The magnetostrictive sensors may be similar to the magnetostrictive sensors disclosed in U.S. Pat. No. 5,717,330 to Moreau et al., which is incorporated herein by reference. The magnetostrictive sensors signal the positions of the first and second hydraulic actuators 20.7 and 50.7 to the potentiometer 168. The potentiometer 168 in turn signals the secondary power assist unit 17.7 to operate based on the position of the second hydraulic actuator 50.7 relative to the position of the first hydraulic actuator 20.7.

The embodiment of the FIG. 8 offers the advantage that operation of the power steering unit 17.7 is based on the movement of the second hydraulic actuator 50.7 relative to the first hydraulic actuator 20.7 rather than being based on the volume of fluid discharged by the helm pump 12.6. The embodiment of FIG. 8 offers the further advantage that there is no need for a mechanical connection between the first hydraulic actuator 20.7 and the second hydraulic actuator 50.7.

It will be understood by a person skilled in the art that although the embodiments of the invention described herein may include a power assist unit, a power assist unit is not required to practice the invention. For example in the embodiments of FIGS. 7 and 8 the power assist units 11.6 and 11.7 may be omitted and the helm pumps 12.6 and 12.8 may be connected directly to the first hydraulic actuators 20.6 and 20.7.

It will further be understood by a person skilled in the art that many of the details provided above are by way of example only and can be varied or deleted without departing from the scope of the invention as set out in the following claims.

What is claimed is:

1. A hydraulic steering system comprising:

a first hydraulic actuator and a second hydraulic actuator, each said hydraulic actuator having two actuator ports, one of said actuator ports of each said hydraulic actuator receiving hydraulic fluid to steer the system in a first direction and discharging hydraulic fluid when the system is steered in a second direction which is opposite the first direction, another of said actuator ports of each said hydraulic actuator receiving hydraulic fluid to steer the system in the second direction and discharging hydraulic fluid when the system is steered in the first direction;

a helm for steering the system in the first direction and the second direction, the helm having a helm pump operatively connected therewith, the helm pump having a first helm hydraulic port and a second helm hydraulic port, the first helm hydraulic port discharging hydraulic fluid when the helm is steered in the first direction and receiving hydraulic fluid when the helm is steered in the second direction, the second helm hydraulic port discharging hydraulic fluid when the helm is steered in the second direction and receiving hydraulic fluid when the helm is steered in the first direction, the helm pump being hydraulically connected with a first of said actuator ports and a second of said actuator ports;

a power hydraulic steering pump hydraulically connected to a third of said actuator ports and a fourth of said actuator ports;

a sensor capable of detecting steering of the system, the sensor being operatively connected with the power steering pump such that the power steering pump pumps hydraulic fluid towards the third of said actuator ports when the helm is steered in the first direction and pumps hydraulic fluid towards the fourth of said actuator ports when the helm is steered in the second direction.

2. The hydraulic steering system as claimed in claim 1, wherein the sensor is an electronic sensor.

3. The hydraulic steering system as claimed in claim 1, wherein the sensor is a pressure sensor.

4. The hydraulic steering system as claimed in claim 1, wherein the sensor is a position sensor.

5. The hydraulic steering system as claimed in claim 1, wherein the power steering pump, the third said actuator port and the fourth said actuator port are hydraulically independent of the helm hydraulic ports during a normal steering operational mode.

6. The hydraulic steering system as claimed in claim 1, wherein the first of said actuator ports and the second of said actuator ports are ports of said first hydraulic actuator, the third of said actuator ports and the fourth of said actuator ports being ports of said second hydraulic actuator.

7. The hydraulic steering system as claimed in claim 1, wherein the first of said actuator ports and the third of said actuator ports are ports of said first hydraulic actuator, the second of said actuator ports and the fourth of said actuator ports being ports of said second hydraulic actuator.

8. The hydraulic steering system as claimed in claim 7, wherein the first hydraulic actuator includes a first manual side having the first of said actuator ports and a first power side having the third of said actuator ports, and the second hydraulic actuator includes a second manual side having the second of said actuator ports and a second power side having the fourth of said actuator ports, each of said power sides comprising a greater volume than each of said manual sides.

9. The hydraulic steering system as claimed in claim 8, further including a tiller operatively connected to one of said manual sides of one of said hydraulic actuators.

10. The hydraulic steering system as claimed in claim 8, further including a tiller operatively connected to said manual sides of said hydraulic actuators by pivot means, each of said hydraulic actuators being angularly spaced respective to each other, and each of said power sides of said hydraulic actuators being operatively mounted by pivot means for pivotally mounting said hydraulic actuators.

11. The hydraulic steering system as claimed in claim 1, including a hydraulic power assist pump hydraulically connected with the helm pump, the first of said actuator ports and the second of said actuator ports, the hydraulic power assist pump assisting in pumping hydraulic fluid towards the first of said actuator ports when the helm is steered in said first direction and for assisting in pumping hydraulic fluid towards the second of said actuator ports when the helm is steered in said second direction.

12. The hydraulic steering system as claimed in claim 1, including a first tiller and a second tiller, said first hydraulic actuator being independently connected to said first tiller, said second hydraulic actuator being independently connected to said second tiller.

13. The hydraulic steering system as claimed in claim 1, including a lock valve, said lock valve operatively connecting in parallel the first hydraulic actuator and second hydraulic actuator.

14. The hydraulic steering system as claimed in claim 1, wherein the sensor is a load sensor.

15. The hydraulic steering system as claimed in claim 14, wherein the load sensor is operatively connected to the first hydraulic actuator.

16. The hydraulic steering system as claimed in claim 1, wherein the sensor is a magnetostrictive sensor.

17. The hydraulic steering system as claimed in claim 16, including a magnet operatively connected to the first hydraulic actuator, said magnetostrictive sensor being positioned to monitor the movement of said magnet.

18. A hydraulic steering apparatus comprising:

a helm having a helm pump operatively connected thereto;

a first hydraulic actuator and a second hydraulic actuator, each said hydraulic actuator having two actuator ports for inputting and discharging hydraulic fluid when the hydraulic actuator is steered, one of said actuator ports of said each hydraulic actuator receiving hydraulic fluid and another of said actuator ports of said each hydraulic actuator discharging hydraulic fluid when the apparatus is steered in a first direction and said one of said actuator ports of said each hydraulic actuator discharging hydraulic fluid and said another of said actuator ports of each said hydraulic actuator receiving hydraulic fluid when the apparatus is steered in a second direction opposite the first direction, the helm pump having helm ports being hydraulically connected to a first of said actuator ports and a second of said actuator ports, a third of said actuator ports and a fourth of said actuator ports being hydraulically independent of the helm hydraulic ports during a normal steering mode of the apparatus;

a sensor for sensing steering by the helm;

a powered hydraulic pump hydraulically connected to the third of said actuator ports and the fourth of said actuator ports and operatively connected to the sensor, the powered hydraulic pump pumping hydraulic fluid to the third of said actuator ports when the apparatus is steered by the helm in the first direction and pumping hydraulic fluid to the fourth of said actuator ports when the apparatus is steered by the helm in the second direction.

19. The hydraulic steering apparatus as claimed in claim 18, wherein the sensor is an electronic sensor.

20. The hydraulic steering apparatus as claimed in claim 18, wherein the sensor is a pressure sensor.

21. The hydraulic steering apparatus as claimed in claim 18, wherein the sensor is a position sensor.

22. The hydraulic steering apparatus as claimed in claim 18, wherein the power steering pump, the third of said actuator ports and the fourth of said actuator ports are hydraulically independent of the helm ports during a normal steering operational mode.

23. The hydraulic steering apparatus as claimed in claim 18, wherein the first of said actuator ports and the second of said actuator ports are ports of said first hydraulic actuator, the third of said actuator ports and the fourth of said actuator ports being ports of said second hydraulic actuator.

24. The hydraulic steering apparatus as claimed in claim 18, wherein the first of said actuator ports and the third of said actuator ports are ports of said first hydraulic actuator, the second of said actuator ports and the fourth of said actuator ports being ports of said second hydraulic actuator.

25. The hydraulic steering apparatus as claimed in claim 18, including a hydraulic power assist pump hydraulically connected with the helm pump, the first of said actuator ports and the second of said actuator ports, the hydraulic power assist pump assisting in pumping hydraulic fluid towards the first of said actuator ports when the helm is steered in said first direction and for assisting in pumping hydraulic fluid towards the second of said actuator ports when the helm is steered in said second direction.

26. A hydraulic steering system including a steering wheel, a first hydraulic steering apparatus, a second hydraulic steering apparatus and two hydraulic actuators, each of the hydraulic actuators having two actuator ports for receiving or discharging hydraulic fluid, the steering wheel and the first hydraulic steering apparatus being hydraulically connected to a first two of said actuator ports, the second hydraulic steering apparatus including a powered hydraulic pump, the powered hydraulic pump being hydraulically independent of the first hydraulic steering apparatus apart from a reservoir, during a normal steering mode of operation, the powered hydraulic pump being hydraulically connected to a second two of said actuator ports, a sensor operatively associated with the first hydraulic steering apparatus for sensing movement of at least one of the hydraulic actuators when the steering wheel is steered, a controller operatively connected to the powered hydraulic pump and to the sensor which operates the powered hydraulic pump to pump hydraulic fluid to said second two of said actuator ports so that the two hydraulic actuators move in conjunction with each other.

27. A hydraulic steering system including a steering wheel, a first hydraulic steering apparatus, a second hydraulic steering apparatus and two hydraulic actuators, each of the hydraulic actuators having two actuator ports for receiving or discharging hydraulic fluid, the steering wheel and the first hydraulic steering apparatus being hydraulically connected to a first two of said actuator ports, the first two of said actuator ports being on a first of said two hydraulic actuators, the second hydraulic steering apparatus including a powered hydraulic pump, the powered hydraulic pump being hydraulically connected to a second two of said actuator ports, the second two of said actuator ports being on a second of said two hydraulic actuators, a sensor operatively associated with the first hydraulic steering apparatus for sensing movement of at least one of the hydraulic actuators when the steering wheel is steered, a controller operatively connected to the powered hydraulic pump and to the sensor which operates the powered hydraulic pump to pump hydraulic fluid to said second two of said actuator ports so that the two hydraulic actuators move in conjunction with each other.

28. A hydraulic steering system including a steering wheel, a first hydraulic steering apparatus, a second hydraulic steering apparatus and two hydraulic actuators, each of the hydraulic actuators having two actuator ports for receiving or discharging hydraulic fluid, the steering wheel and the first hydraulic steering apparatus being hydraulically corrected to a first two of said actuator ports, the second hydraulic steering apparatus including a powered hydraulic pump, the powered hydraulic pump being hydraulically connected to a second two of said actuator ports, a sensor operatively associated with the first hydraulic steering apparatus for sensing movement of at least one of the hydraulic actuators when the steering wheel is steered, a controller operatively connected to the powered hydraulic pump and to the sensor which operates the powered hydraulic pump to pump hydraulic fluid to said second two of said actuator ports so that the two hydraulic actuators move in conjunction with each other, the sensor and the controller being electronic.

* * * * *